US006382147B1

(12) United States Patent
Plohberger

(10) Patent No.: US 6,382,147 B1
(45) Date of Patent: May 7, 2002

(54) VALVE DRIVE FOR A VALVE OF AN INTERNAL COMBUSTION ENGINE

(75) Inventor: Diethard Plohberger, Jenbach (AT)

(73) Assignee: Jenbacher Aktiengesellschaft, Jenbach (AT)

( * ) Notice: Subject to any disclaimer, the term of this patent is extended or adjusted under 35 U.S.C. 154(b) by 0 days.

(21) Appl. No.: 09/666,821

(22) Filed: Sep. 21, 2000

(30) Foreign Application Priority Data

Sep. 22, 1999 (AT) ..... A 1617/99

(51) Int. Cl.[7] ..... F01L 1/16; F01L 9/02
(52) U.S. Cl. ..... 123/90.12; 123/90.49
(58) Field of Search ..... 123/90.12, 90.13, 123/90.15, 90.16, 90.49

(56) References Cited

U.S. PATENT DOCUMENTS 4,796,573 A 1/1989 Wakeman et al. ..... 123/90.16
5,216,988 A * 6/1993 Taxon ..... 123/90.12
5,503,120 A * 4/1996 Shirey et al. ..... 123/90.12
5,577,468 A * 11/1996 Weber ..... 123/90.12
6,192,841 B1 * 2/2001 Vorih et al. ..... 123/90.12

FOREIGN PATENT DOCUMENTS

EP 0 255 668 A2 7/1987

* cited by examiner

*Primary Examiner*—Weilun Lo
(74) *Attorney, Agent, or Firm*—Lorusso & Loud

(57) ABSTRACT

A valve drive for a valve of an internal combustion engine, wherein the valve is connected to a main piston which is arranged in a cylinder chamber and which for opening of the valve can be acted upon by pressure fluid flowing into the cylinder chamber, wherein there is provided a closing spring which urges the valve in the closing direction, and wherein there is provided a throttle by way of which a part of the pressure fluid flows out of the cylinder chamber in a throttled flow during the closing movement of the valve.

2 Claims, 3 Drawing Sheets

VALVE DRIVE FOR A VALVE OF AN INTERNAL COMBUSTION ENGINE

BACKGROUND OF THE INVENTION

The present invention concerns a valve drive for a valve of an internal combustion engine, wherein the valve is connected to a main piston which is arranged in a cylinder chamber and which for opening of the valve can be acted upon by pressure fluid flowing into the cylinder chamber, and wherein there is provided a closing spring which urges the valve in the closing direction.

In the case of hydraulic valve drives, it is desirable to decelerate the closing movement of the valve, before the valve head comes into contact with the valve seat, in such a way that the speed of contact of the valve with its seat does not become too high. In that case, excessive valve wear would occur. In the known arrangements, shortly before the valve reaches the closed position, a piston engages into a cylinder with a defined, small diameter difference. Due to the narrow gap between the piston and the cylinder, oil flows out of the cylinder through the narrow gap at high speed and with a high pressure difference, whereby the contact movement of the valve is damped. That principle is moreover also used in all kinds of hydraulic shock absorbers to afford a terminal abutment damping action.

The disadvantage of this arrangement is that, for reasons of production tolerance, a relatively large percentage of the valve stroke movement must be employed for the damping procedure in order to afford an adequate damping action. In addition the strength of the damping action and thus the speed of impact of the valve against its seat depends to a high degree on the diameter tolerance of the damper piston and cylinder and thus the cross-section of the gap. In addition the damper travel must be so great that an adequate damping action is produced both in the new condition and also when the valve and the valve seat are worn. The difference in the damper travel between a new and a worn valve/valve seat system may however certainly be up to 5 mm in the case of large engines. Due to the necessity for over-sizing of the damper travel, energy losses which increase with increasing valve wear occur due to excessively strong damping. Furthermore the valve movement becomes increasingly slower in the proximity of the valve seat so that an unwanted variation in the valve closing time can occur.

Therefore the object of the invention is to provide a valve drive which is easier to produce and which is substantially independent of the valve wear condition.

BRIEF SUMMARY OF THE INVENTION

In accordance with the invention that is achieved in that there is provided a throttle by way of which a part of the pressure fluid flows out of the cylinder chamber in a throttled flow during the closing movement of the valve.

Due to the throttle, the speed of the valve as it approaches the valve seat is reduced in such a way that it comes into contact with the valve seat 'softly'.

From the structural point of view it is particularly simple if there is arranged in the cylinder chamber on the side of the main piston remote from the valve an intermediate piston which is movable relative to the main piston and which is provided with a throttle bore. The intermediate piston subdivides the cylinder chamber so that a part of the pressure fluid has to flow away through the throttle bore.

In order to fill the cylinder chamber between the main piston and the intermediate piston in each cycle with an amount of pressure fluid which is adequate for the damping action, it is preferably provided that a compression spring is disposed between the main piston and the intermediate piston. By virtue of the spring which presses against the main piston and the intermediate piston, pressure fluid is sucked into the intermediate chamber when the spring is relieved.

It is desirable if the intermediate piston has a preferably peg-shaped or pin-shaped abutment, on the side which is towards the pressure oil line. The abutment provides that a hollow space is formed on the side of the intermediate piston which is towards the pressure oil line, that hollow space ensuring that the pressure oil can unimpededly flow in and out by way of the pressure oil line independently of the position of the throttle bore.

The size of the throttle bore has an essential influence on the damping action. It has proven desirable for the diameter of the throttle bore to be less than 10% and preferably between about 5 and 7% of the diameter of the intermediate piston.

BRIEF DESCRIPTION OF THE DRAWINGS

Further features and details of the invention are apparent from the description hereinafter of FIGS. 1 through 3 showing a valve drive according to the invention in different positions during a cycle.

DESCRIPTION OF THE PREFERRED EMBODIMENT

The valve drive comprises in known manner a valve head V with a closing spring S and a hydraulic main piston HK. When the cylinder chamber Z is supplied with pressure oil, through the cross-section D, the main piston HK causes the valve to open. When the oil pressure is removed the valve V closes and the oil is displaced out of the cylinder chamber Z.

Figure 1:
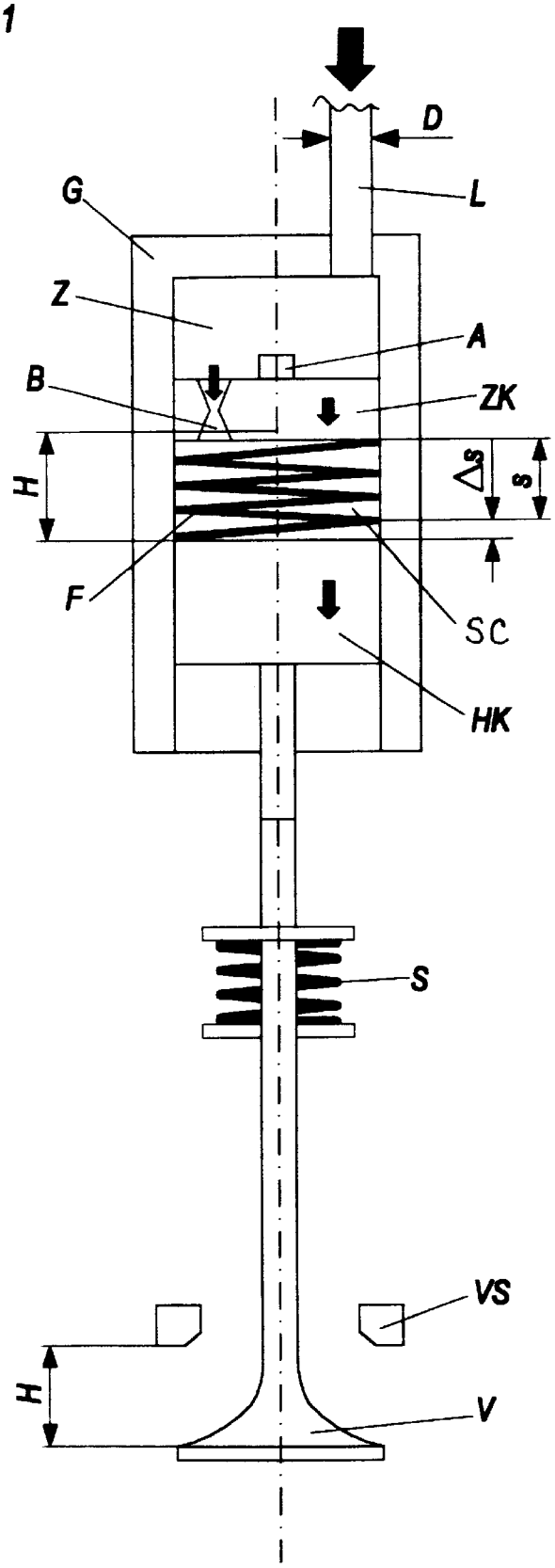

Operational description of the impact damping action:

FIG. 1: Upon opening of the valve the oil pressure acts on the intermediate piston ZK. Also between the intermediate piston ZK and the main piston HK is oil which transmits the pressure to the main piston HK. Due to the force of the spring F and the throttle bore B in the intermediate piston ZK, the distance between the intermediate piston ZK and the main piston HK increases during the opening stroke movement of the valve V by the differential travel $\Delta s$. In that situation the spring F urges the intermediate piston ZK and the main piston HK away from each other, with oil flowing through the throttle bore B in the direction of the spring chamber SC of the spring F.

Figure 2:
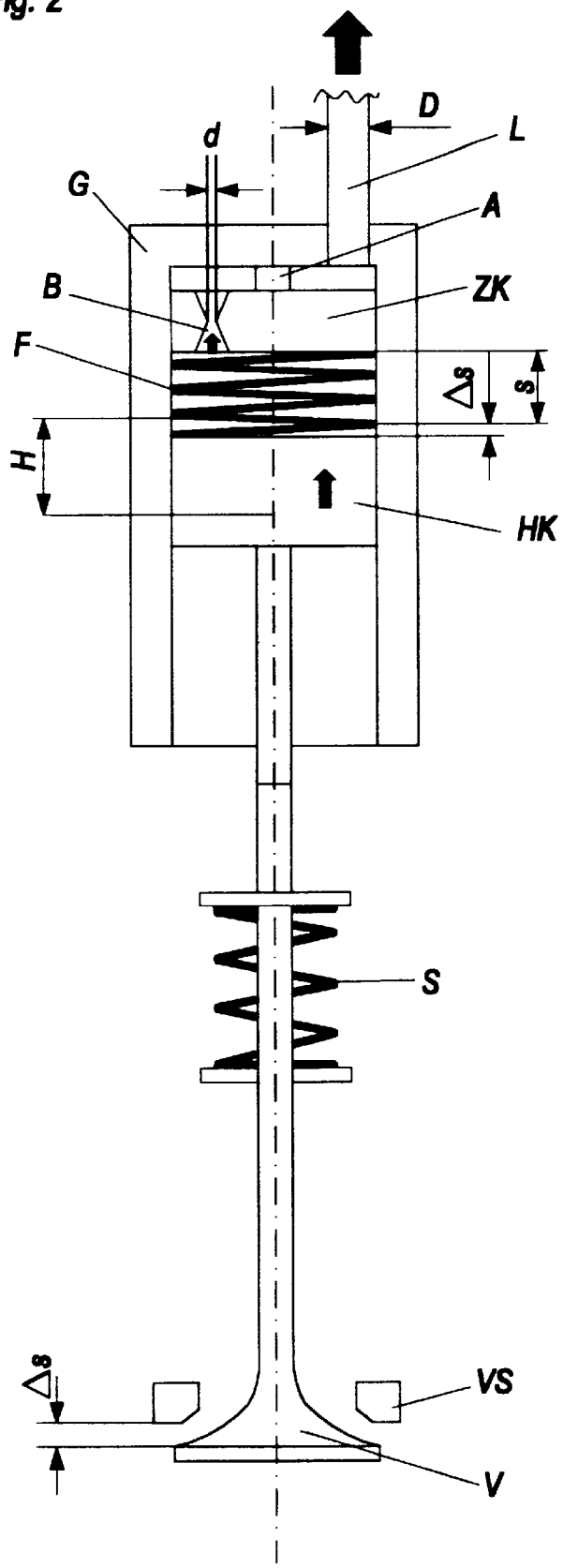

FIG. 2: Upon closure of the valve V at a given moment in time the remaining opening stroke movement of the valve is $\Delta s$. From that moment the intermediate piston ZK bears with its peg-shaped abutment A against the cylinder housing G. So that the valve V can completely close, the distance between the main piston HK and the intermediate piston ZK must now be reduced from $s+\Delta s$ to original s. That is effected by the spring F being compressed and the oil escaping from the space between the main piston HK and the intermediate piston ZK through the throttle bore B. The nature of the throttle bore B therefore determines the speed with which the valve comes into contact with its valve seat VS. In that respect the spring F has only a slight influence as it is weak in comparison with the closing spring S.

Figure 3:
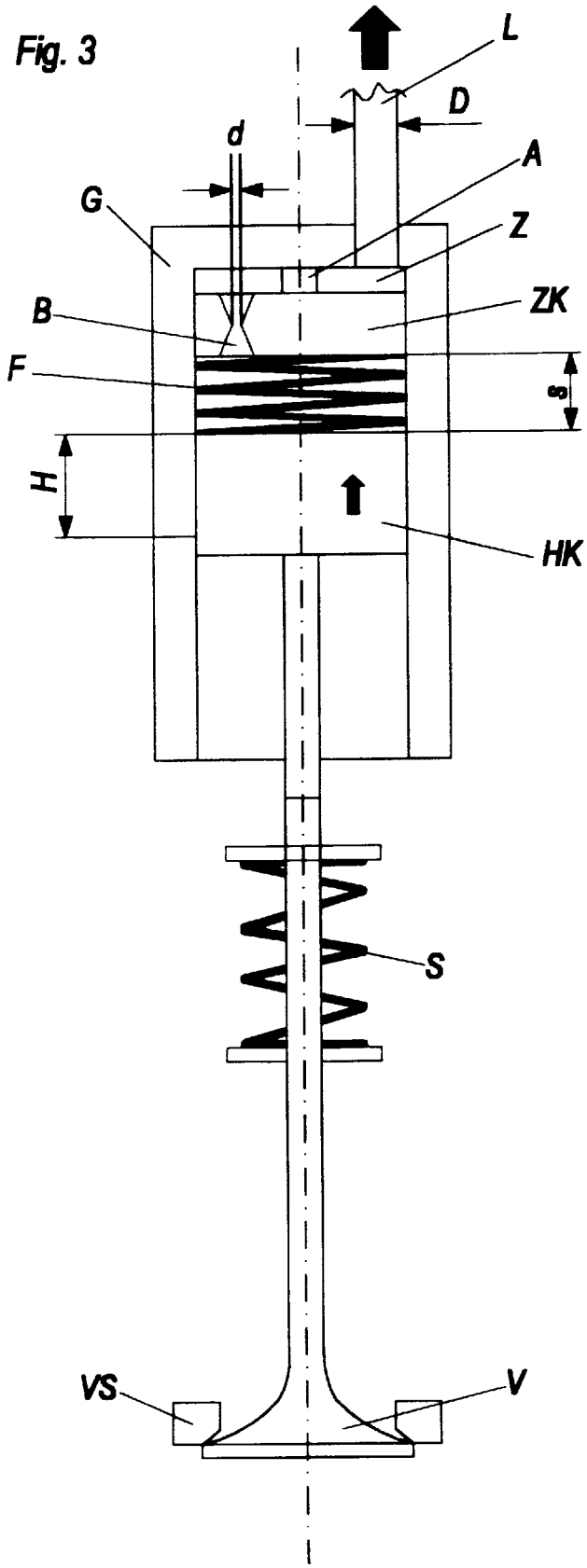

FIG. 3: Shows the final state and at the same time the initial state of the valve stroke movement.

The advantage of the arrangement according to the invention is that the damping travel $\Delta s$ is independent of the distance s between the main piston HK and the intermediate piston ZK. The distance s changes in the course of time with increasing valve wear. The damping travel Δs however is only a function of time, the diameter d of the throttle bore B, the spring force of the spring F and the viscosity of the oil.

The throttle bore B can be produced very accurately. Leakage between the main piston HK and the intermediate piston ZK on the one hand and the cylinder housing G on the other hand can be totally avoided by means of the usual seals so that overall there can be no deviations due to tolerances in the damping travel between a number of valve drives of an engine.

The system is furthermore self-regulating insofar as, with cold oil and/or with a high oil viscosity, the increase in distance Δs turns out to be less than when the oil is hot and/or the oil viscosity is low. In the former case however the closing speed of the valve V is also greater due to the higher level of wall friction of the oil in the lines and the through-flow resistance through the throttle B so that overall a shorter damping travel Δs is sufficient or is desirable.

As an alternative to the described embodiment it is possible to envisage the throttle action being achieved by multi-way valves which operate very rapidly.

What is claimed is:

1. A valve drive for a valve of an internal combustion engine, wherein the valve is connected to a main piston which is arranged in a cylinder chamber and which for opening of the valve can be acted upon by pressure fluid flowing into the cylinder chamber, and wherein there is provided a closing spring which urges the valve in the closing direction, characterized in that arranged in the cylinder chamber on the side of the main piston, which is remote from the valve, is an intermediate piston which is movable relative to the main piston and which is provided with at least one throttle bore, and wherein the main piston and the intermediate piston are of the same diameter and are guided jointly movably in the same cylinder, and that arranged between the main piston and the intermediate piston is a compression spring which urges the main piston and the intermediate piston away from each other during the opening travel of the valve by an amount, with pressure fluid flowing by way of the throttle bore or bores into the space between the main piston and the intermediate piston, and that at the end of the closing movement of the valve the main piston and the intermediate piston are urged together, a part of the pressure fluid flowing out of the space between the main piston and the intermediate piston in a throttled flow by way of the throttle bore or bores.

2. A valve drive for a valve of an internal combustion engine, wherein the valve is connected to a main piston which is arranged in a cylinder chamber and which for opening of the valve can be acted upon by pressure fluid flowing into the cylinder chamber, and wherein there is provided a closing spring which urges the valve in the closing direction, characterized in that arranged in the cylinder chamber on the side of the main piston, which is remote from the valve, is an intermediate piston which is movable relative to the main piston and which is provided with at least one throttle bore and on the side towards a pressure oil line the intermediate piston has a pin-shaped abutment, and that arranged between the main piston and the intermediate piston is a compression spring which urges the main piston and the intermediate piston away from each other during the opening travel of the valve by an amount, with pressure fluid flowing by way of the throttle bore or bores into the space between the main piston and the intermediate piston, and that at the end of the closing movement of the valve the main piston and the intermediate piston are urged together, a part of the pressure fluid flowing out of the space between the main piston and the intermediate piston in a throttled flow by way of the throttle bore or bores.

* * * * *